United States Patent [19]

Novotny

[11] 4,123,752

[45] Oct. 31, 1978

[54] BURGLAR ALARM

[76] Inventor: Raymond J. Novotny, 52 Summit Trail, Sparta, N.J. 07871

[21] Appl. No.: 729,278

[22] Filed: Oct. 4, 1976

[51] Int. Cl.[2] ..... G08B 13/08

[52] U.S. Cl. ..... 340/545; 200/61.76; 340/541; 340/542

[58] Field of Search ..... 340/274 R, 274 C, 276; 70/333 R, 416, 424, 439; 200/61.62, 61.64, 61.72, 61.73, 61.74, 61.75, 61.76; 116/85, 86

[56] References Cited

U.S. PATENT DOCUMENTS

| | | | |
|---|---|---|---|
| 3,653,022 | 3/1972 | Tall | 340/274 |
| 3,714,643 | 1/1973 | Sosin et al. | 200/61.76 |
| 3,720,937 | 3/1973 | Lang et al. | 340/274 |
| 3,851,325 | 11/1974 | Maged | 340/274 |
| 3,866,201 | 2/1975 | Beiswenger | 340/274 |

*Primary Examiner*—John W. Caldwell, Sr.
*Assistant Examiner*—Donnie L. Crosland

[57] ABSTRACT

A battery-operated burglar alarm mounted to the inside of a door and capable of being armed from either side. Two slides on the device provide for two modes of operation in cooperation with a plate fastened to the door frame. One slide permits manual arming of the alarm from the inside with the door closed. Another slide permits manual pre-arming of the alarm from the inside with the door open and subsequent automatic arming of the alarm as the door is closed. Depending upon the mode of operation, unauthorized opening of the door can either lock the door and instantaneously sound an alarm or sound an alarm after a predetermined time with the door unlocked. A combination switch deactivates the alarm and another switch can alter the combination.

8 Claims, 16 Drawing Figures

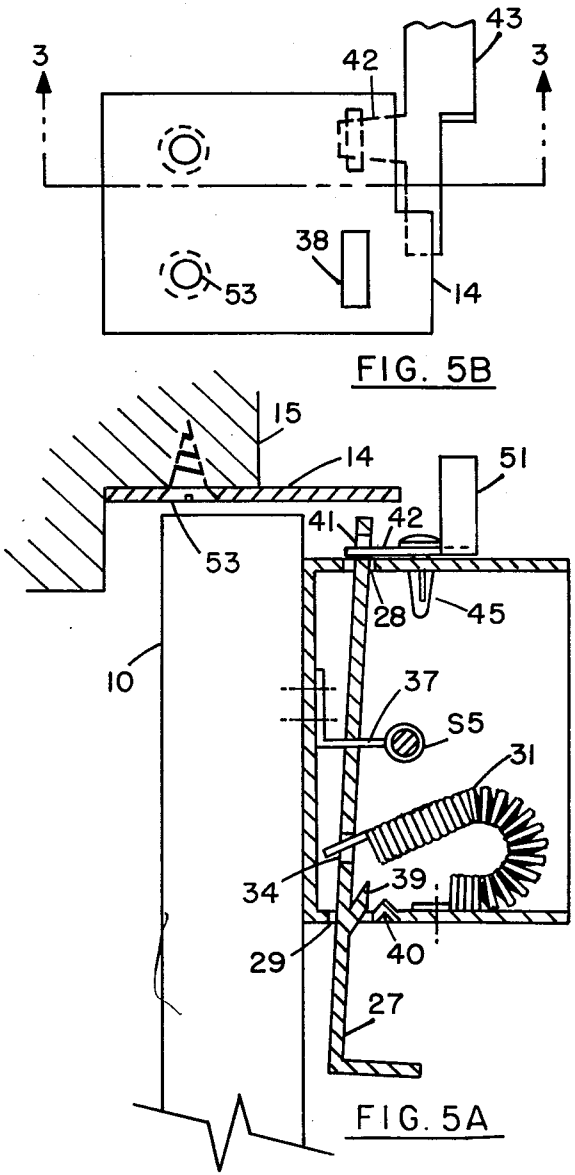
FIG. 5B
FIG. 5A
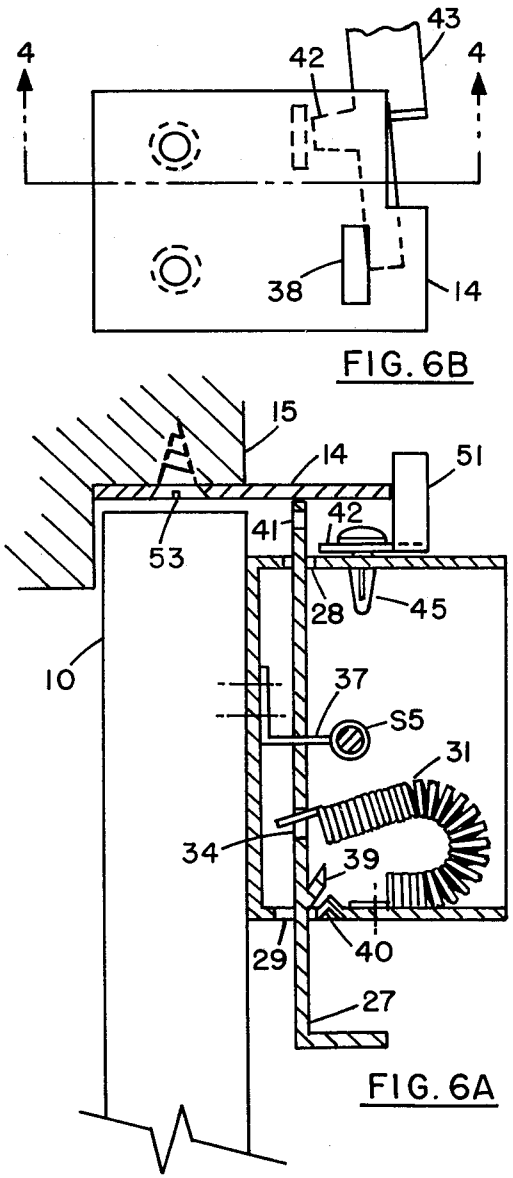
FIG. 6B
FIG. 6A
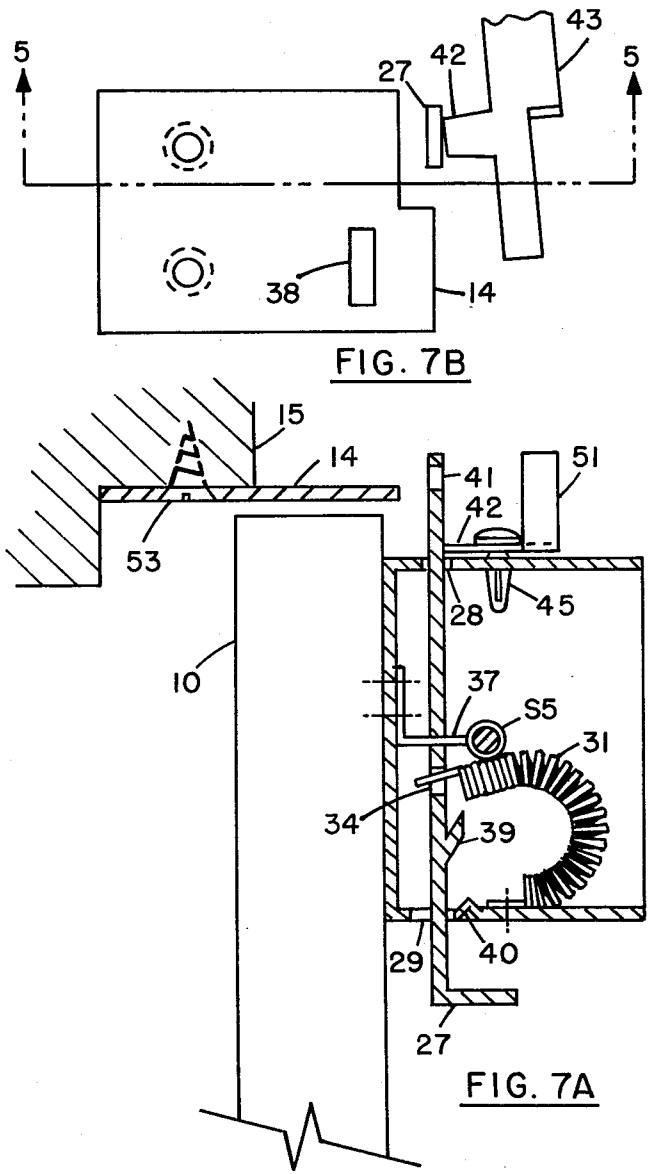
FIG. 7B
FIG. 7A

BURGLAR ALARM

The present invention relates to a battery operated burglar alarm adapted to a door or the like and more specifically to a burglar alarm having mechanical arming and pre-arming means, mechanical locking and electrical latching and adjustable delay means that automatically operate to sound an alarm when unauthorized opening of the door or the like occurs.

It is the object of the present invention to provide a novel, simple, compact, self-contained battery operated burglar alarm that is reliable in action, effective in use and inexpensive to manufacture.

Another object of the device is to provide a burglar alarm that is easily installed on a door or the like by the average home owner or apartment dweller without requiring specialized installation tools, material, knowledge, technique of rework of the existing door and frame structure.

It is a further object of this invention to provide home owners and particularly apartment dwellers, who must leave and return to their premises daily, a convenient, simple and reliable alarm device for their doors that does not require additional keys or other separate means to arm or de-arm the device upon leaving or entering their premises.

It is also an object of this invention to provide a burglar alarm for a door or the like that is capable of two modes of operation; namely, an internal mode for arming a closed door from the protected enclosure side to protect the inhabitants and property therein, and an external mode for pre-arming a door while it is open from the protected enclosure side prior to closing the door from the unprotected enclosure side and thereby automatically arming the door to protect the property therein while the inhabitants are away from the premises.

Another object of this invention is to provide a device, the location of which is readily accessible to the authorized person but is mounted in a relatively inaccessible or tamper-proof location to the unauthorized person.

Still, a further object of this invention is to provide means for making the present device inoperative during periods of normal door use.

The above objects as well as other and further objects, features and advantages of the present invention will be manifest in the following detailed description and preferred embodiment thereof when read in connection with the accompanying drawings which form a part of this specification. However, it must be clearly understood that these descriptions and drawings are not to be construed as defining the limits of the invention, for which purpose reference is made to the appended claims.

In the drawings wherein like reference characters refer to like parts through the several views and sections:

FIG. 5A is a sectional view (line 3—3 of FIG. 5B) showing the sole actuation mode slide in the pre-armed position with the door open prior to closing.

FIG. 5B is a top view of FIG. 5A.

FIG. 6A is a sectional view (line 4—4 of FIG. 6B) showing the sole actuation mode slide in the armed position with the door in the closed position after the sequence followed in FIG. 5 above. This figure is also representative of the pre-armed position of the slide 26 with respect to plate 14 for the combined instantaneous alarm actuation and locking mode shown in FIG. 8A.

FIG. 6B is a top view of FIG. 6A.

FIG. 7A is a sectional view (line 5—5 of FIG. 7B) showing the sole actuation mode slide in the alarm actuation position with the door in the open position. This figure is also representative of the alarm actuation and locking position of the slide 26 with respect to plate 14 for the combined instantaneous alarm actuation and locking mode shown in FIG. 9A.

FIG. 7B is a top view of FIG. 7A.

Figure 8B:
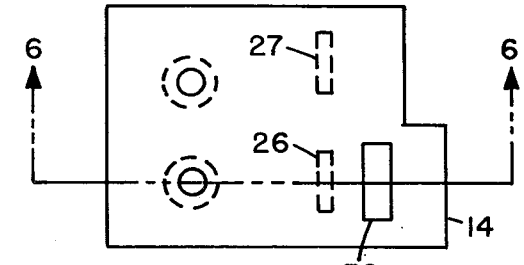
Figure 8A:
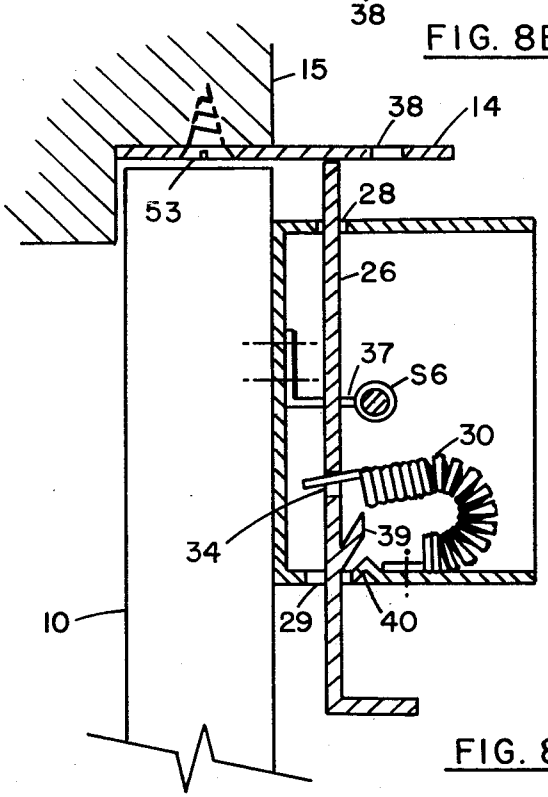

FIG. 8A is a sectional view (line 6—6 of FIG. 8B) showing the combined instantaneous alarm actuation and locking mode slide in the armed position with the door in the closed position.

FIG. 8B is a top view of FIG. 8A.

Figure 9B:
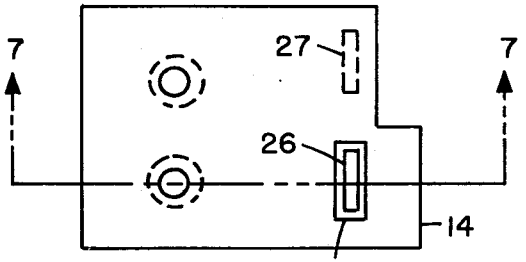
Figure 9A:
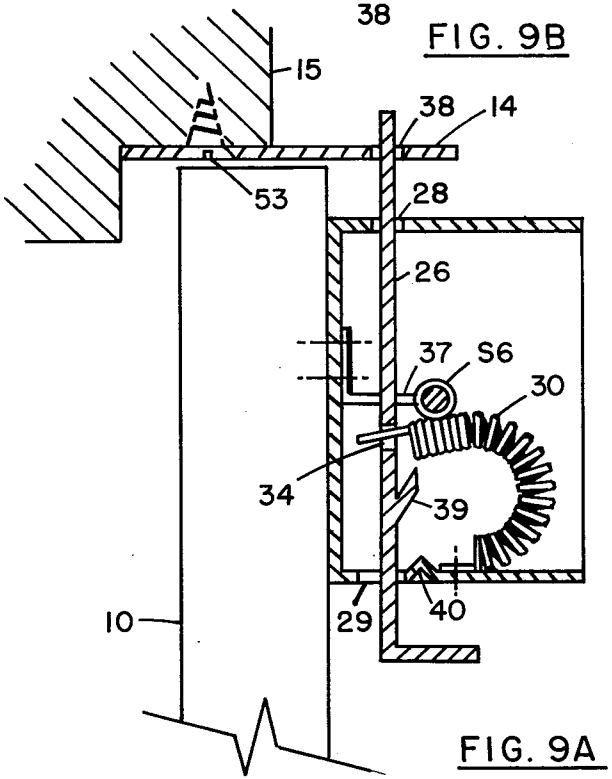

FIG. 9A is a sectional view (line 7—7 of FIG. 9B) showing the combined instantaneous alarm actuation and locking mode slide in the instantaneous alarm actuation and locking position with the door slightly open.

FIG. 9B is a top view of FIG. 9A.

Figure 10:
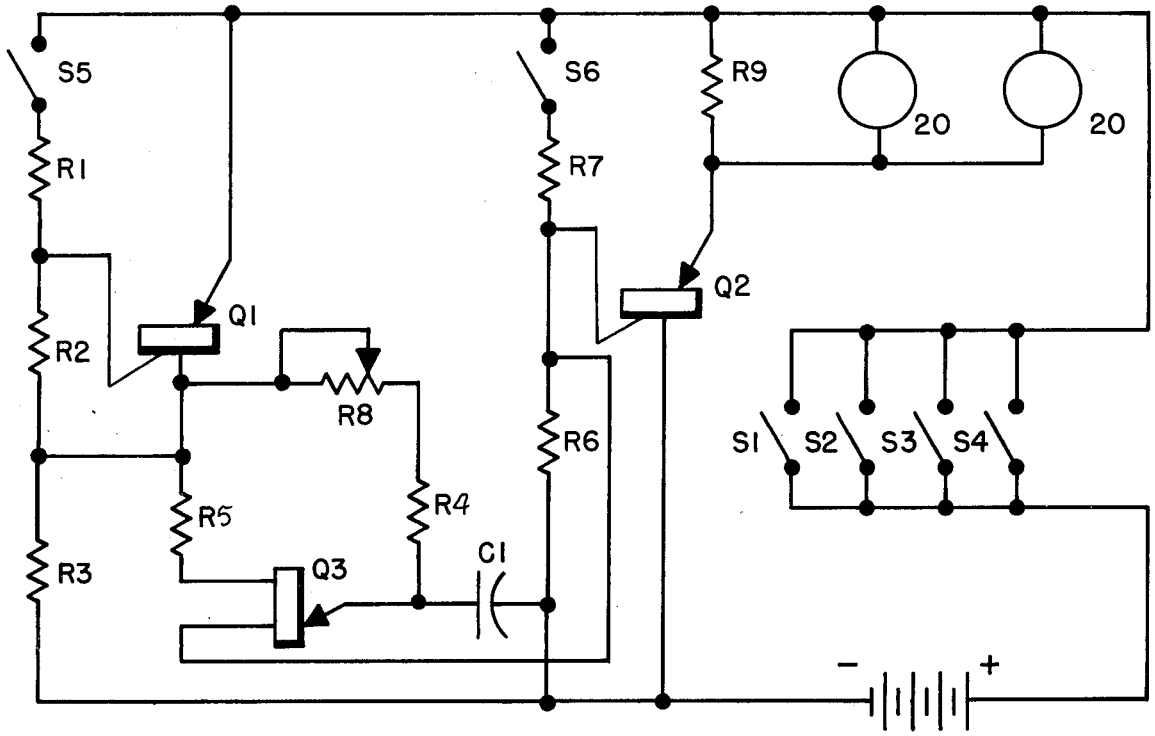

FIG. 10 is a wiring diagram of the basic electrical circuit with the single pole single throw combination switches shown.

Figure 11:
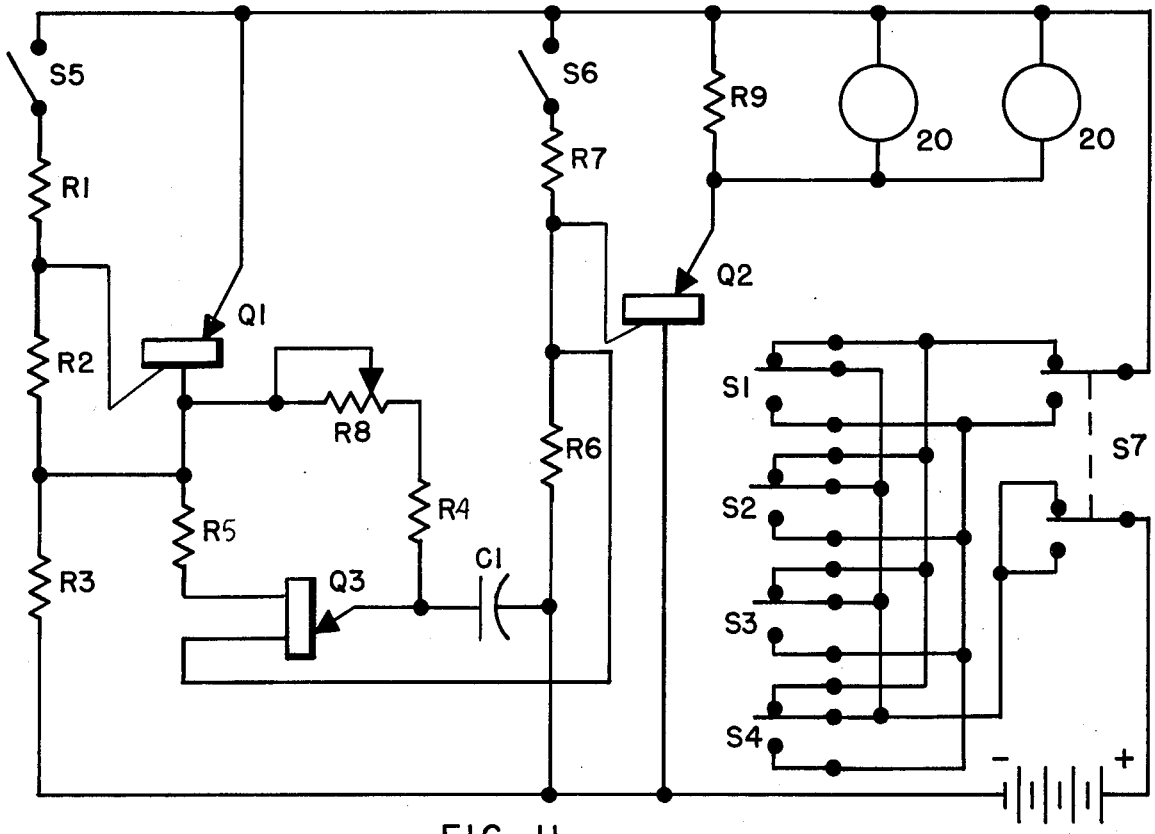

FIG. 11 shows the use of single pole double throw switches in combination with a double pole double throw switch to change the switch combinations required to deactivate the alarm.

Figure 1:
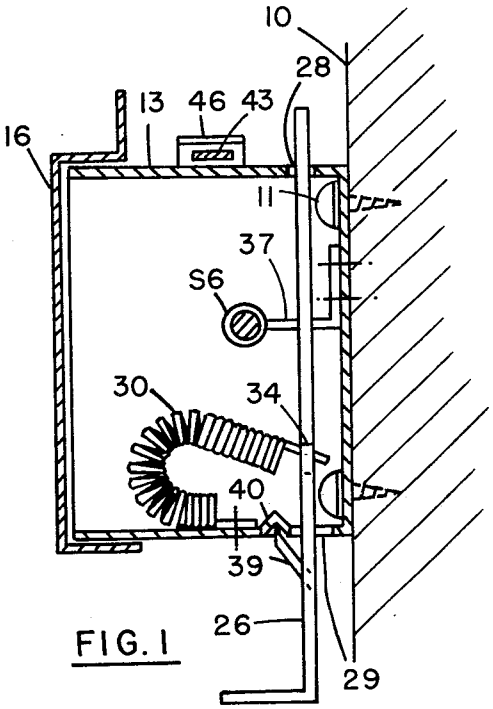
FIG. 1 is a sectional view of the device taken in a plane (line 1-1 of FIG. 2) inside the housing side flange and between the two slides and including the primary and secondary electrical contacts. The slide is shown in the inoperative position.
Figure 2:
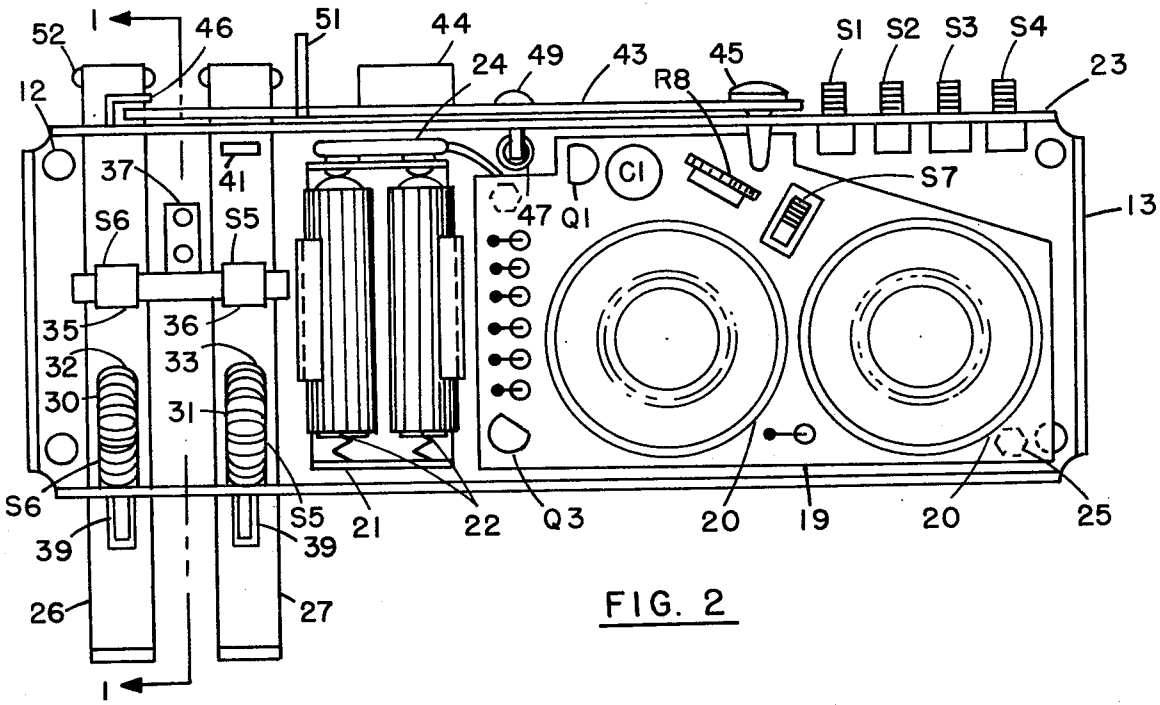
FIG. 2 is a front view of the battery operated burglar alarm with the front cover of the housing and the door jamb plate removed. The two slides are shown in the inoperative position.

Referring in detail to the drawings, wherein like and related numerals and symbols designate like and related parts throughout the several views, the device as shown in FIG. 1 is mounted on the protected enclosure side of the door 10 by means of screws 11 through screw holes 12 provided in the back of housing 13 and having the housing 13 attached to the door 10. With the exception of the plate 14, shown in FIGS. 5, 6, 7, 8 and 9, which is separately attached to the door jamb 15 with screws 53, also shown in FIGS. 5, 6, 7, 8 and 9, the housing 13 has attached to it or contains within it all the necessary operational and structural elements of the device including a front cover 16 which is fastened to the front of housing 13 by means of screws 17 and contains openings 18 to facilitate the transmission of sound through front cover 16. Referring to FIG. 2 the housing 13, preferably fabricated of metal, contains a printed circuit board 19 which has electrically operated horns 20 fastened to it. The printed circuit board 19 contains thereon the basic electrical elements shown in FIGS. 10 and 11 with the exception of switches S1, S2, S3, S4, S5 and S6. The housing 13 also contains the battery holder 21, batteries 22 and combination switches S1, S2, S3 and S4 mounted to the top surface 23 of housing 13. A battery snap type connector 24 mechanically connects the battery holder 21 to the printed circuit board 19. Standoffs 25 isolate and fasten the printed circuit board 19 to the housing 13.

The printed circuit board 19 is characterized by two modes of operation triggered by the closing of switches S6 or S5 shown in FIG. 10. Closing switch S6 triggers the gate of SCR Q2 and instantly sounds horns 20 provided at least one of the parallel linked switches S1, S2, S3 and S4 are closed. Assuming a variation in the "ON"-"OFF" attitude of the four switches as mounted on housing 13, only one combination in sixteen will assure an open circuit to deactivate the alarm. If instead of switch S6, switch S5 is closed, then the gate of SCR Q1 is triggered which in turn activates and R-C circuit composed of resistors R8 (variable), R5 and capacitor C1. The voltage build-up on capacitor C1 eventually fires unijunction transistor Q3 which in turn triggers the gate of SCR Q2 to sound horns 20 after a predetermined time. The predetermined time or time delay is determined by the setting of variable resistor R8 and the absolute value of capacitor C1 assuming, of course, that at least one of the four switches S1, S2, S3 and S4 are closed. The basic characteristics of the circuits described are not new in the art and need not be discussed further.

The switches S1, S2, S3 and S4 are physically mounted on the top surface 23 of housing 13 and electrically connected to the printed circuit board 19. To achieve the two modes of operation of the device characterized by the closing of switches S5 or S6 of FIG. 10, the housing 13 also contains two slides, a left slide 26 which is characterized by a combined instantaneous alarm actuation and locking mode, and a right slide 27 which is characterized by a sole alarm actuation mode having a time delay. Both slides are guided in housing 13 through the top and bottom slots 28 and 29.

Resilient springs 30 and 31 which constitute primary electrical contacts 32 and 33 are fastened at one end to housing 13 and the other ends of resilient springs 30 and 31 fastened to their respective left slide 26 and right slide 27 by means of slide apertures 34 biasing the slides 26 and 27 in an upward direction. Upward movement of the slides eventually brings the resilient springs 30 and 31 in contact with secondary electrical contacts 35 and 36 located at the extremities of a bifurcated arm 37. The bifurcated arm 37 is mounted to the housing 14 and electrically insulated therefrom and also extends outward therefrom between the slides 26 and 27. Vertical movement of the left slide 26 to enable the primary electrical contact 32 to meet the secondary electrical contact 35 is equivalent to closing switch S6 and results in the combined instantaneous sounding of horns 20 and locking mode of slide 26 with the aperture 38 in plate 14 (FIGS. 8 and 9). Vertical movement of the right slide 27 to enable the primary electrical contact 33 to meet the secondary electrical contact 36 is equivalent to closing switch S5 and results in sounding horns 20 after a predetermined time (FIGS. 5, 6 and 7).

Further, referring to FIGS. 8 and 9, plate 14 fastened to door jamb 15 has an aperture 38 located therein and in alignment with left slide 26. Therefore, to achieve the operational mode equivalent to closing switch S6 the alarm is manually armed from the protected enclosure side of the door 10 with the door closed. The procedure is to first depress the left slide 26 downward from housing 13 to disengage the slide stop 39 from the housing detent 40 to remove the left slide 26 from its inoperative position during the normal opening and closing of door 10 and to permit the left slide 26 to move upward until it engages the bottom of plate 14 and, in effect, places the alarm in an armed condition (FIGS. 8A and 8B). Unauthorized opening of door 10 moves the housing 13 with the left slide 26 with respect to plate 14 until alignment of the aperture 38 in plate 14 with left slide 26 is achieved (FIGS. 9A and 9B). The additional vertical motion of the left slide 26 now permits primary electrical contact 32 to meet secondary electrical contact 35 and instantaneously sound horns 20 and simultaneously lock door 10 because of the protrusion of left slide 26 through aperture 38 in plate 14. This is shown in FIG. 9A and 9B.

Next, to achieve the operational mode equivalent to closing switch S5 the alarm is manually armed from the protected enclosure side of the door with the door 10 open (FIGS. 5A and 5B). The procedure is to first depress the right slide 27 downward from housing 13 to disengage the slide stop 39 from the housing detent 40 to remove the right slide 27 from its inoperative position (FIG. 1) during the normal opening and closing of door 10 and to permit the pre-arming sot 41 of right slide 27 to engage the tongue 42 of the pre-arming lever 43 to effect the pre-arming condition of the right slide 27 (FIGS. 5A and 5B).

Figure 4:
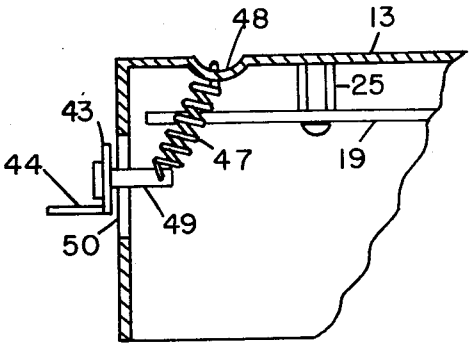
FIG. 4 is a sectional view (line 2—2 of FIG. 3) taken through the pre-arming lever and return spring.
Figure 3:
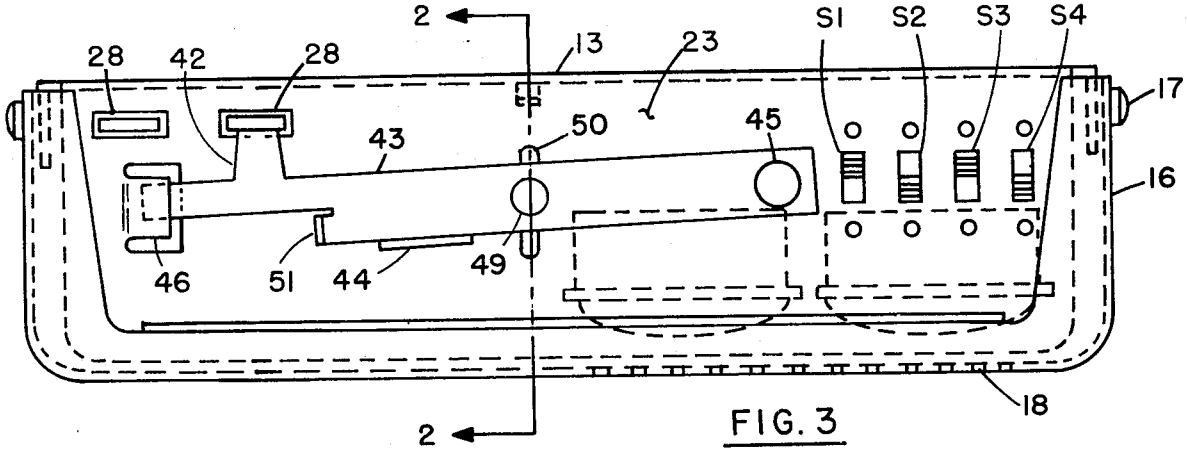
FIG. 3 is a top view of the burglar alarm showing the two slides in an inoperative position with the front cover in place.

Finger tab 44 shown in FIG. 3 helps to retract the pre-arming lever 43 if it were necessary to withdraw the tongue 42 from the pre-arming slot 41 of right slide 27. The pre-arming lever 43 is attached to the top of housing 13 by means of fastener 45 which permits the pre-arming lever 43 to freely pivot about the fastener 45. At the other end of the pre-arming lever 43, the housing slide retainer 46 which is integral with the top of housing 13 restricts the pre-arming lever 43 to its pivotal motion parallel to the top of housing 13. Spring 47 (FIG. 4) biases the tongue 42 of pre-arming lever 43 toward the right slide 27 containing pre-arming slot 41. Spring 47 (FIG. 4) is attached to the back of housing 13 at slotted hole 48 and to pre-arming lever 43 at post 49. Slot 50 in top of housing 13 provides the necessary clearance for post 49 to move with pre-arming lever 43. Closing the door 10 from the outside now permits the pre-arming lever vertical projection 51 to engage the edge of plate 14 just prior to closing door 10 to retract the tongue 42 of pre-arming lever 43 from the pre-arming slot 41 of right slide 27 and permit further vertical upward movement of right slide 27 until it engages plate 14 as the door 10 is closed and, in effect, places the alarm in an armed condition (FIGS. 6A and 6B). Unauthorized opening of door 10 moves the housing 13 with the right slide 27 with respect to plate 14 until it slides off plate 14 and moves vertically upward until primary electrical contact 33 meets secondary electrical contact 36 and sounds horns 20 after a predetermined time (FIGS. 7A and 7B).

The vertical downward and upward movements of left slide 26 and right slide 27 are restricted by the slide ears 52 and slide stops 39 respectively which in cooperation with the outside top and bottom surfaces of housing 13 provide the necessary limited movement of the slides. FIG. 11 shows the addition of a double pole double throw switch S7 which, in effect, can reverse any combination of the switches S1, S2, S3 and S4 that are mounted on the top surface 23 of housing 13. However, if it were desired to change the combination from a relatively protected location, e.g. from within the housing, then switch S7 would be mounted on the printed circuit board 19 within the alarm device (FIG. 2). This would require that the front cover 16 first be removed by removing screws 17 in order to reverse the switch combination required by switches S1, S2, S3 and S4 to deactivate the alarm.

I claim:

1. In combination with a door and a door jamb, an alarm comprising a housing mounted to the inside or protected enclosure side of said door and a plate mounted to said door jamb, said housing containing audible alarm means, manual arming means and manual pre-arming means, alarm actuation means, locking means, electric circuit latching and electric circuit time delay means having electric supply means, alarm "ON" and "OFF" electric switching means attached to said housing; said manual arming means attached to said housing and cooperating with said plate and said alarm actuation means to permit manual arming of said alarm from said inside of said door while said door is closed, said electric latching circuit cooperating with said alarm actuation means and said locking means cooperating with said plate to simultaneously and instantaneously actuate said audible alarm and lock said door; said pre-arming means attached to said housing and cooperating with said plate and said alarm actuation means to permit manual pre-arming of said alarm from said inside of said door while said door is open, said manual pre-arming means and said alarm actuation means cooperating with said plate to permit automatic arming of said alarm when said door is closed, said electric circuit latching and said electric circuit time delay means cooperating with said alarm actuation means and said plate to actuate said audible alarm means after the opening of said door; said manual arming means and said manual pre-arming means having stop means adapted to engage said housing to place said alarm actuation means of said alarm in an inoperative condition.

2. The invention as defined in claim 1, said alarm actuation means comprising electric switch means, said electric supply means comprising a battery and said audible alarm means comprising a horn.

3. The invention as defined in claim 2, said alarm "ON" and "OFF" electric switching means comprising combination electric switching means in series with said electric supply means to activate or deactivate said alarm.

4. In combination with a door and a door jamb, an alarm comprising a housing mounted to the inside or protected enclosure side of said door, a front cover fastened to said housing and forming a hollow enclosure therewith, said housing having upper and lower and side surfaces to locate and mount said cover to said housing, a plate having an aperture there-through mounted to the jamb of said door and located in proximity to said housing, said housing containing audible alarm means, electric circuit latching means and electric circuit time delay means having electric supply means, "ON" and "OFF" combination electric switching means; said housing having manual arming means and manual pre-arming means comprising two slides attached to said housing and capable of sliding movement within openings in said upper and lower surfaces of said housing, said two slides manually operable and cooperating with said plate and to engage said plate to provide means for two modes of operation of said alarm; a combined instantaneous alarm actuation and locking mode and a sole alarm actuation time delay mode; said slides slidably attached to said housing and extending through said openings of said upper and lower surfaces of said housing; said combined instantaneous alarm actuation and locking means manually engageable with said plate to effect on armed condition of said alarm when said door is closed from the inside of said door; said sole alarm actuation time delay means cooperating with pre-arming means movably attached to said housing and manually engageable with said sole alarm actuation timedelay means to effect a pre-armed position of said alarm actuation time delay means while said door is open in preparation for closing said door from the outside or unprotected side of said door, said pre-arming means cooperating with said plate to further effect an armed condition of said alarm when said door is closed; electric switch means fixidly attached to said housing and insulated therefrom and cooperating with said combined instantaneous alarm actuation and locking means to simultaneously and instantaneously actuate said electric circuit latching means to sound said audible alarm means and in cooperation with said aperture in said plate to lock said door; said sole alarm actuation time delay means cooperating with said pre-arming means and said plate to actuate said electric circuit latching and time delay means to sound said audible alarm means after a pre-determined time; either of said two modes of operation of said alarm capable of independent operation after the opening of said door; said combined instantaneous alarm actuation and locking means and said sole alarm actuation time delay means having stop means adapted to manually engage said housing to place said two modes of operation in an inoperative condition; said "ON" and "OFF" combination electric switching means capable of activating or deactivating said audible alarm.

5. The invention as defined in claim 4 having said combined instantaneous alarm actuation and locking means and said sole alarm actuation time delay means comprising slides having resilient means biasing said slides toward said plate, said slide of said sole alarm actuation time delay means having pre-armed position means located on said slide, said pre-arming means comprising a lever having a tongue-like projection and attached to the upper surface of said housing at one end thereof and said lever having said tongue-like projection at the opposing end thereof, said lever having resilient means biasing said tongue-like projection of said lever toward said slide of said sole alarm actuation time delay means, said tongue-like projection of said lever manually engageable and cooperating with said pre-armed position means in said slide prior to the closing of said door to effect the pre-armed position of said slide of said sole alarm actuation time delay means, said lever having an upright projection cooperating with said plate to disengage said tongue-like projection from said pre-armed position means of said slide during the closing of said door thereby enabling said slide to engage said plate in the armed position and enable said slide of said sole alarm actuation time delay means to effect the said sole alarm actuation time delay mode after the opening of said door.

6. The invention as defined in claim 5 having said electric switch means comprise primary electric contact means and secondary electric contact means; said resilient means biasing said slides toward said plate and comprising said primary electric contact means attached to said housing at one end thereof and in electrical contact therewith and attached to said slide of said combined instantaneous alarm actuation and locking means and to said slide of said sole alarm actuation time delay means; said secondary electric contact means fixedly attached to said housing and electrically insulated therefrom, said primary electric contact means engaging said secondary electric contact means when either of said slides is actuated during the opening of said door.

7. The invention as defined in claim 3 having variable time delay means and additional electric switch means cooperating with said "ON" and "OFF" electric switching means whereby the combination of said "ON" and "OFF" electric switching means required to deactivate said alarm can be altered.

8. The invention as defined in claim 6 having variable time delay means and additional electric switch means cooperating with said "ON" and "OFF" electric switching means whereby the combination of said "ON" and "OFF" electric switching means required to deactivate said alarm can be altered.

* * * * *